US010757515B2

(12) United States Patent
Troelsen et al.

(10) Patent No.: US 10,757,515 B2
(45) **Date of Patent: *Aug. 25, 2020**

(54) HEARING AID DEVICE HAVING AN ANTENNA

(71) Applicant: Oticon A/S, Smørum (DK)

(72) Inventors: Jens Troelsen, Smørum (DK); Poul Henriksen, Veksø (DK)

(73) Assignee: Oticon A/S, Smørum (DK)

( * ) Notice: Subject to any disclaimer, the term of this patent is extended or adjusted under 35 U.S.C. 154(b) by 0 days.

This patent is subject to a terminal disclaimer.

(21) Appl. No.: 16/279,771

(22) Filed: Feb. 19, 2019

(65) Prior Publication Data

US 2019/0261100 A1 Aug. 22, 2019

(30) Foreign Application Priority Data

Feb. 21, 2018 (EP) ..... 18157897

(51) Int. Cl.
*H04R 25/00* (2006.01)
*H01Q 1/27* (2006.01)
*H01Q 1/52* (2006.01)

(52) U.S. Cl.
CPC ..... *H04R 25/554* (2013.01); *H01Q 1/273* (2013.01); *H04R 25/60* (2013.01); *H04R 25/609* (2019.05); *H01Q 1/52* (2013.01); *H04R 25/602* (2013.01); *H04R 2225/51* (2013.01); *H04R 2225/57* (2019.05); *H04R 2420/07* (2013.01)

(58) Field of Classification Search
CPC .... H04R 25/554; H04R 25/60; H04R 25/602; H04R 25/603; H04R 25/609; H04R 2225/51; H04R 2225/57; H04R 2225/61; H01Q 1/273; H01Q 1/52
USPC ..... 381/315, 322, 324, 329
See application file for complete search history.

(56) References Cited

U.S. PATENT DOCUMENTS

2014/0140554 A1 5/2014 Ruaro
2014/0328507 A1* 11/2014 Rabel ..... H04R 25/554 381/315
2015/0043763 A1* 2/2015 Troelsen ..... H01Q 1/273 381/315
2018/0359576 A1* 12/2018 Nikles ..... H01Q 1/273

FOREIGN PATENT DOCUMENTS

EP 2 835 863 A1 2/2015
WO WO 2005/081583 A1 9/2005
WO WO 2015/127973 A1 9/2015

* cited by examiner

*Primary Examiner* — Jesse A Elbin
(74) *Attorney, Agent, or Firm* — Birch, Stewart, Kolasch & Birch, LLP

(57) ABSTRACT

A hearing aid comprises a housing, comprising: a substrate carrying a wireless interface, the substrate further carrying a processor, the substrate arranged in the housing; an antenna arranged in the housing, the antenna being connected to the wireless interface; the antenna configured to emit and/or receive electromagnetic fields, an electronic element, connected to the processor via an electrical connection line; wherein a decoupling element is provided in the electrical connection line wherein the decoupling element has a characteristic frequency at the frequency, at which the antenna is tuned to radiate and/or receive the electromagnetic fields.

19 Claims, 7 Drawing Sheets

HEARING AID DEVICE HAVING AN ANTENNA

FIELD

The present disclosure relates to hearing aid devices having an antenna for radio frequency communication. More particularly, the disclosure relates to in-the-ear hearing aid devices having an antenna for radio frequency communication.

BACKGROUND

Hearing aid devices, i.e. hearing aids, for placement at least partly in or at the ear canal of a wearer are very dense applications and when integrating antennas in such hearing devices, there are many constraints to consider.

Antenna performance, i.e. sending/and receiving performance, is of great consideration. In particular, in small devices such as hearing aids antenna performance may be impeded by multiple factors. More so in custom style hearing devices where metallic conductors and components may often be placed individually with a resulting high risk of less predictable antenna performance as a result. Further, in small devices with limited power supply the consideration of antenna performance is of more importance than in larger devices with a mains supply where energy supply could be unlimited and used for boosting antenna signals.

Further, especially in ITE (in the ear) and CIC (completely in the canal) style hearing devices, it is a problem to accommodate antennas for the provision of the wireless transmission and/or reception. The ITE and CIC styles enables the wearer to have a hearing device that is as inconspicuously as possible.

Therefore, there is a need to provide a solution that addresses at least some of the above-mentioned problems. The present disclosure provides at least an alternative to the prior art.

SUMMARY

The hearing aids described herein may facilitate an improved wireless communication to and from a hearing aid. Furthermore, the present disclosure may provide an alternative solution compared to the prior art.

According to the present disclosure, a hearing aid may have a housing which may comprise a substrate carrying a wireless interface, wherein the substrate may carry a processor, and the substrate may then be arranged in the housing. Alternatively, the processor and the wireless interface may be carried on different substrates. The hearing aid may further comprise an antenna arranged in the housing, the antenna may be at least partially in the housing. Further, the antenna may be connected to the wireless interface and the antenna may be configured to emit and/or receive electromagnetic fields. The antenna may have at least one operational frequency or frequency range. The antenna may have more than one operational frequency or operational frequency range, e.g. as an example the antenna may be configured to operate both at 2.4 GHz and at 5.1 GHz. Further, the hearing aid may comprises an electronic element, which may be connected to the processor via an electrical connection line, wherein a decoupling element may be provided in the electrical connection line and wherein the decoupling element has a characteristic frequency at the frequency, at which the antenna is tuned to radiate and/or receive the electromagnetic fields. The electrical connection line is preferably a wire, i.e. metal in the form of a usually very flexible or bendable thread. The electronic element may preferably be provided on or at a substrate that is separate from the antenna.

This provides a hearing aid with a wireless communication interface, wherein coupling from the antenna to the electronic element may be reduced. This further allows for a more efficient operation of the antenna, including lower loss in signals emitted and/received by the antenna, and possibly less crosstalk between the antenna and the electronic element. Furthermore, as the operation of the antenna can be more efficient, an emission power of the antenna can be lowered and an energy consumption required for the emission of the antenna can be reduced. On the other hand, if signals can be more efficiently received by the antenna, further signal processing can be facilitated due to a higher signal quality and hence, an energy consumption can be reduced. Even further, since coupling of the antenna to the electronic element is reduced, the emission characteristic of the antenna depends less on the placement of the electronic element with respect to the antenna, so that the emission characteristic of the antenna is more predictable. In turn, this leads to a greater flexibility when designing and building a custom built hearing aid, since the electronic element can be positioned with lower restrictions.

In a hearing aid according to the present disclosure, the electronic element may be positioned at an end portion of the antenna.

For most antenna types, an end portion of the antenna is the part where the electric field is highest and may accordingly be more sensitive to electromagnetic radiation, so that if the electronic element is close to an end portion of the antenna, a coupling between the antenna and the electronic element may be stronger as compared to the case where the electronic element is further away from the end portion of the antenna.

Hence, the present disclosure provides a decoupling configuration of the electronic element and the connection line connecting the electronic element, even in the case that the electronic element is close to an end portion of the antenna. This allows for greater flexibility in hearing aids, and in particular when designing and building a custom built hearing aid.

The hearing aid may further comprise a battery, and at least a part of the antenna may be arranged at least partly around the battery. This arrangement allows for a more compact design of the hearing aid, since less space is consumed. Additionally, the battery may function as a ground plane for the antenna, which furthermore improves the emission characteristics. Furthermore, the operation of the antenna can be more efficient, emission power of the antenna can be lowered and an energy consumption required for the emission of the antenna can be reduced. Even further, the battery can provide electromagnetic shielding between the antenna and other parts of the hearing aid.

Furthermore, such a configuration allows for an improved decoupling of the electronic element and the connection line connecting the electronic element, which allows for a greater flexibility when designing and building a custom built hearing aid. Even further, since coupling of the antenna to the electronic element is reduced, the emission characteristic of the antenna is more predictable, which in turn leads to a greater flexibility when designing and building a custom built hearing aid.

In a hearing aid, in particular in a hearing aid to be positioned at least partly in the ear canal, at least part of the antenna may be embedded in a faceplate in the housing of the hearing aid. The faceplate in this context in the part of the hearing aid housing facing the surrounding. The faceplate may also hold other components, such as an input transducer or several input transducers in case a directional microphone system is to be established. In case the hearing aid is equipped with a battery that needs to be replaced, a battery lid of a battery compartment is usually also provided in the faceplate. If a rechargeable battery is used in the hearing aid, the battery may be positioned further away from the faceplate as the user does not need to access the battery directly. As mentioned other components may be positioned in the faceplate, such as interfaces or the like. The back side, or inner side, of the faceplate may also support components, e.g. the antenna may be held in a groove. Also, other structural elements may be attached to the faceplate, such as a frame or other structure for supporting a module with the substrate carrying the wireless interface and/or the processor or the like.

The antenna may comprise an external part arranged outside the housing. When a part of the antenna is arranged outside the housing, less space inside the housing is consumed. Hence, with this configuration the housing of the hearing aid device can be made smaller. Furthermore, using such a configuration, a coupling from the antenna to the electronic element can be reduced as detailed above, which again allows for an improvement in signal quality, and a reduction of the battery usage as detailed above.

Further, when a part of the antenna is arranged outside the housing, if it is arranged so that the antenna is arranged in an outward direction of the wearer's head, the influence of the antenna on the wearer's head can be reduced.

The decoupling element may be, or include, an inductor such as a coil, a ferrite-core inductor coil, a choke, a decoupling coil or a decoupling coil having a ferrite core or a band-stop filter. The decoupling element may be composed of two or more elements, e.g. a coil and a capacitor.

By the use of this configuration, a decoupling element can be realized, which decouples the electronic element from the antenna, hence achieving the above-mentioned effects can be realized. A decoupling element may comprise any type of inductance or filter element, which reduces the coupling of electromagnetic energy onto electrical components. The decoupling element provides at least a dampening of a signal around at least one of the operational frequencies of the antenna. The dampening may be substantial or complete.

The antenna may be tuned to radiate and/or receive electromagnetic energy in the frequency range of 50 MHz to 10 GHz, the antenna may be tuned to radiate and/or receive electromagnetic energy at 2.4 GHz and/or 5 GHz. Other operational frequencies may be conceivable.

Within this range radio communication is presently allowed in various bands in most countries without any license. Examples of such bands are the ISM bands. This also means that there is likely to be some noise in these frequency bands, and this is a further reason for the antenna to be effective. The antenna is usable for either digital or analog coding of signals.

The electronic element may comprise multiple electrical connection lines, and a decoupling element may then be included in each, or at least some, of the multitude of electrical connection lines. This configuration allows improving the decoupling between the electronic element and the antenna.

The hearing aid may be to be placed behind the outer ear of a user, in the outer ear of a user, in the inner ear of a user, in the inner canal of the ear of a user, or in the bony region of the ear of the user. Further, the hearing aid may be composed of a part to be positioned in the ear of the user and another part to be disposed behind the pinna of the user, and a flexible, elongated element may connect the two, both electrically and mechanically.

The electrical connection line may comprise, or be, one or more of a single wire, a twisted pair of single wires, a conductive path on a substrate, such as a ridged substrate or flexible substrate, a flexible conductor on flexible a substrate, a coaxial cable, or combinations thereof. The electrical connection line may be provided separately from the antenna, meaning that there is no direct mechanical connection between the two for the majority part of the antenna and/or the electrical connection line. This could e.g. be that the electrical connection line and the antenna are both connected at one end to the same substrate, but for a part of the length of each, they are not connected.

The electronic element may be an input transducer, such as a microphone, a volume wheel, a magnetic switch, a mechanical switch, a button, a battery, a plug, a sensor, such as an accelerometer or a GMR switch or any other type of sensor, a printed circuit board, a transducer, a grounding element, or a combination thereof.

The antenna may comprises or may be arranged as a monopole antenna, a dipole antenna, a slot antenna, an open slot antenna, an IF-antenna, a F-antenna, a PIFA-antenna, a two-arm monopole antenna, a three-arm monopole antenna, a multiple-arm monopole antenna, a multiple-arm antenna, a folded monopole antenna, a patch antenna, a loop antenna, a flex antenna, a ceramic chip antenna, an injection-molded thermoplastic part with integrated electronic circuit traces, a printed antenna or any combinations thereof.

The hearing aid may further comprises a parasitic antenna element arranged in the housing. This configuration allows to improve the antenna performance as well as to improve a directivity of the antenna. As a consequence, a coupling between the antenna and the electronic element can be reduced, so that the above mentioned effects can be achieved.

The hearing aid may further comprises a reflective antenna element arranged in the housing arranged to direct an emitted signal in a given direction, e.g. away from the users head when the hearing aid is carried in its operational state. This configuration allows to improve the antenna performance as well as to improve a directivity of the antenna.

The substrate may comprise the wireless interface on one side of the substrate, and the processor at another side. Since the antenna is connected to the wireless interface, this configuration reduces a coupling between the antenna and electronic elements, which are placed on the other side of the substrate, where the processor is placed.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

DETAILED DESCRIPTION

Figure 1:
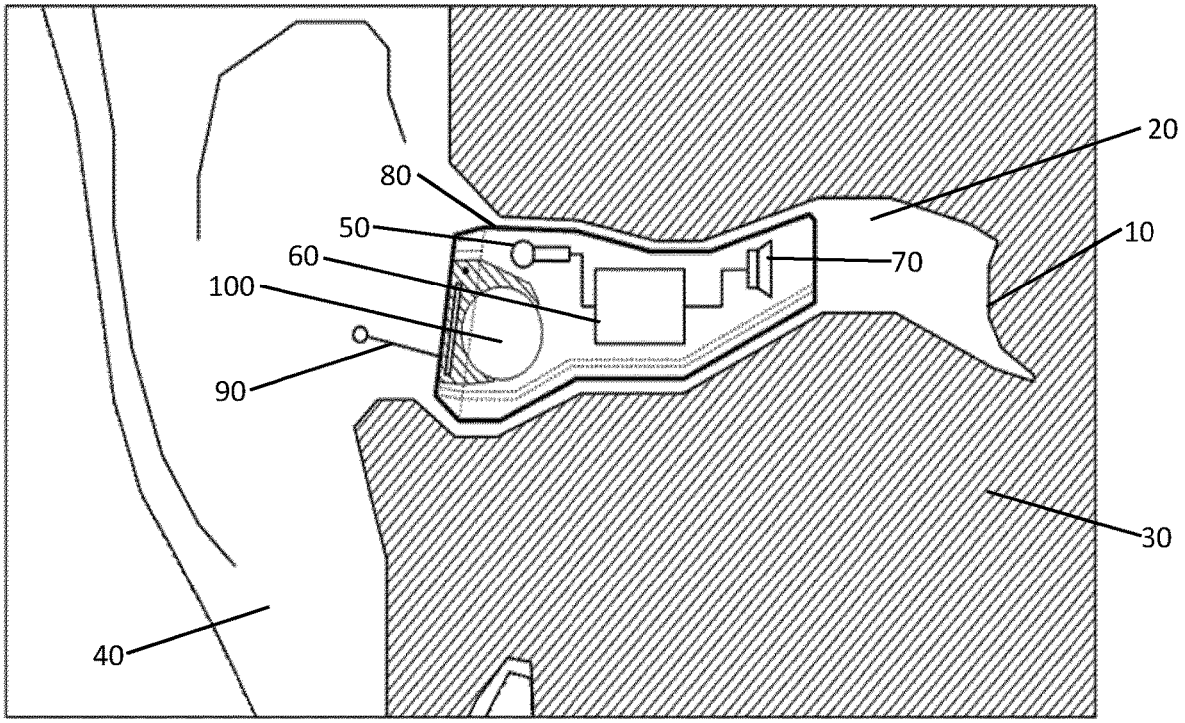
FIG. 1 illustrates a side view of a schematic representation of an ITE hearing aid.

The detailed description set forth below in connection with the appended drawings is intended as a description of various configurations. The detailed description includes specific details for the purpose of providing a thorough understanding of various concepts. However, it will be apparent to those skilled in the art that these concepts may be practiced without these specific details. Several aspects of the apparatus and methods are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

In the description below and in the figures, the same components are described by the same reference numerals as in the other examples, and hence, a repetition of a description of such common components is omitted or abbreviated for the sake of conciseness. Furthermore, only differences to the preceding examples are described and a repetition of a description of common components will be omitted or abbreviated.

The electronic hardware may include microprocessors, microcontrollers, digital signal processors (DSPs), field programmable gate arrays (FPGAs), programmable logic devices (PLDs), gated logic, discrete hardware circuits, and other suitable hardware configured to perform the various functionality described throughout this disclosure. A computer program shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

A hearing device may include a hearing aid that is adapted to improve or augment the hearing capability of a user by receiving an acoustic signal from a user's surroundings, generating a corresponding audio signal, possibly modifying the audio signal and providing the possibly modified audio signal as an audible signal to at least one of the user's ears. The "hearing device" may further refer to a device such as an earphone or a headset adapted to receive an audio signal electronically, possibly modifying the audio signal and providing the possibly modified audio signals as an audible signal to at least one of the user's ears. Such audible signals may be provided in the form of an acoustic signal radiated into the user's outer ear, or an acoustic signal transferred as mechanical vibrations to the user's inner ears through bone structure of the user's head and/or through parts of middle ear of the user or electric signals transferred directly or indirectly to cochlear nerve and/or to auditory cortex of the user.

The hearing device is adapted to be worn in any known way. This may include i) arranging a unit of the hearing device behind the ear with a tube leading air-borne acoustic signals into the ear canal or with a receiver/loudspeaker arranged close to or in the ear canal such as in a Behind-the-Ear type hearing aid, and/or ii) arranging the hearing device entirely or partly in the pinna and/or in the ear canal of the user such as in a In-the-Ear type hearing aid or In-the-Canal/Completely-in-Canal type hearing aid, or iii) arranging a unit of the hearing device attached to a fixture implanted into the skull bone such as in Bone Anchored Hearing Aid, or iv) arranging a unit of the hearing device as an entirely or partly implanted unit such as in Bone Anchored Hearing Aid.

A "hearing system" refers to a system comprising one or two hearing devices, and a "binaural hearing system" refers to a system comprising two hearing devices where the devices are adapted to cooperatively provide audible signals to both of the user's ears. The hearing system or binaural hearing system may further include auxiliary device(s) that communicate(s) with at least one hearing device, the auxiliary device affecting the operation of the hearing devices and/or benefiting from the functioning of the hearing devices. A wired or wireless communication link between the at least one hearing device and the auxiliary device is established that allows for exchanging information (e.g. control and status signals, possibly audio signals) between the at least one hearing device and the auxiliary device. Such auxiliary devices may include at least one of remote controls, remote microphones, audio gateway devices, mobile phones, public-address systems, car audio systems or music players or a combination thereof. The audio gateway is adapted to receive a multitude of audio signals such as from an entertainment device like a TV or a music player, a telephone apparatus like a mobile telephone or a computer, a PC. The audio gateway is further adapted to select and/or combine an appropriate one of the received audio signals (or combination of signals) for transmission to the at least one hearing device. The remote control is adapted to control functionality and operation of the at least one hearing devices. The function of the remote control may be implemented in a SmartPhone or other electronic device, the SmartPhone/electronic device possibly running an application that controls functionality of the at least one hearing device.

In general, a hearing device includes such as i) an input unit such as a microphone for receiving an acoustic signal from a user's surroundings and providing a corresponding input audio signal, and/or ii) a receiving unit for electronically receiving an input audio signal. The hearing device further includes a signal processing unit for processing the input audio signal and an output unit for providing an audible signal to the user in dependence on the processed audio signal.

The input unit may include multiple input microphones, e.g. for providing direction-dependent audio signal processing. Such directional microphone system is adapted to enhance a target acoustic source among a multitude of acoustic sources in the user's environment. This may be achieved by using conventionally known methods. The signal processing unit may include an amplifier that is adapted to apply a frequency dependent gain to the input audio signal. The signal processing unit may further be adapted to provide other relevant functionality such as compression, noise reduction, etc. The output unit may include an output transducer such as a loudspeaker/receiver for providing an air-borne acoustic signal transcutaneously or percutaneously to the skull bone or a vibrator for providing a structure-borne or liquid-borne acoustic signal.

Generally, electrical properties of antennas, such as radiation efficiency, gain, resonant frequency, frequency bandwidth, polarization of the radiated wave, or electrical impedance due to the reciprocity theorem of electromagnetics are the same whether the antenna is sending or receiving electromagnetic energy. For example, the sensitivity of an antenna for electromagnetic energy of a given direction and polarization is identical to the emission pattern of the antenna, when it is used as a sending antenna. Hence, if in the present disclosure a certain property of a sending antenna is described, it is evident for those skilled in the art that the respective property of the antenna, when used as a receiver, is described as well. Unless described explicitly otherwise, no distinction may be made between the properties of an antenna, which is used for sending, and an antenna, which is used for receiving electromagnetic energy, and the antenna can be considered as either sending or receiving, whichever is more convenient.

The antenna may be an electric or a magnetic antenna. The antenna may further comprise or be arranged as a monopole antenna, a dipole antenna, a slot antenna, a two-arm monopole antenna, a three-arm monopole antenna, a multiple-arm monopole antenna, a multiple-arm antenna, a folded monopole antenna, a patch antenna, a loop antenna, a fractal antenna, a flex antenna, a ceramic chip antenna, an injection-molded thermoplastic part with integrated electronic circuit traces, a printed antenna or any combinations thereof.

In the following, a wireless communication link having a sending part and a receiving part is considered. The wireless communication link can be used to transmit an audio signal from a smartphone to the hearing aid. In this case, the sending part is the smartphone, and the receiving part is the hearing aid. The wireless communication can also be used to send information from the hearing aid to the smartphone, such as e.g. digital information for acknowledging a receipt of data. In this case, the sending part is the hearing aid, and the receiving part is the smartphone.

Furthermore, in the following electrical and/or magnetic coupling between an input element and an output element is considered. An input element may be an antenna, which is driven by a wireless interface to radiate electromagnetic energy. An output element in the context of electrical and/or magnetic coupling may be a close-by electrical wire, electrical component or any other metallic part. If the input element is driven to radiate electromagnetic energy in order to transmit signals, the electromagnetic energy may couple to the output element, which means that the electric field or magnetic field generated by the input element induces an electric voltage or an electric current in the output element, respectively. Since the input element is generally driven by high-frequency signals, the signals generated in the output element are also high-frequency signals of the same frequency. Such coupling is generally described in terms of stray capacitance or mutual inductance between the input element and the output element. The coupling will induce and generate an electric signal inside the output element, which is generally an unwanted signal, and may be either directly audible (e.g. by coupling to electrical connection line connected to a loudspeaker) or may be input to a signal processing unit, which causes an increased noise in the signal processing unit, hence causing a reduction of a signal/noise ratio. This lower signal/noise ratio may be directly audible and may disturb the wearer or it can cause an increase in battery consumption in order to compensate or correct the lower signal/noise ratio.

Furthermore, the antenna is described as the input element, which couples electromagnetic energy to the output element. Hence, the electromagnetic energy coupled to the electrical connection line and to the electronic element will decrease the amount of electromagnetic energy emitted by the hearing aid. Therefore, the signal level at the receiving part of the wireless communication link will be lower. In order to maintain a constant signal quality, the emission power of the antenna therefore needs to be raised, which requires additional power to be provided by a battery, so that the lifetime of the battery is reduced.

In case an electronic element is operated using an electronic connection line, the electronic element can also be described as the input element, and the antenna can be described as the output element. An operation of the electronic element gives rise to an emission of an electromagnetic wave by the electrical connection line. This emission may couple into the antenna and induce unwanted electrical signals in the wireless interface, which can be considered as noise. If at the same time, the antenna is used as a receiver for receiving electromagnetic signals from the sending part of the wireless communication link, such noise disturbs the received signals, and lowers the signal/noise ratio of the signals. In the end, such noise may therefore disturb the wearer of the hearing aid. In order to maintain a constant signal quality of the received signal, a more complex signal processing may be employed in order to filter out such noise, or e.g. a further amplification of the received signals may be required. Therefore again, such noise will require additional provision of power from the battery, hence reducing the lifetime of the battery.

According to the disclosure a decoupling element is provided, which reduces the coupling and crosstalk between the antenna and the electronic element with the electrical connection line.

FIG. 1 shows a side view of a schematic representation of an In-the-Ear (ITE) hearing aid. In the ITE configuration, a hearing aid having a custom made housing 80 is placed in an ear canal 20 of a wearer. The custom made housing can be flexible or have a flexible outer portion which allows it to be inserted into the ear canal. The housing comprises a microphone 50, a signal processing unit 60 and a loudspeaker (output transducer) 70 sending acoustic sound through the inner part of the ear canal 20 to the eardrum 10 in the wearer's head 30.

A front plate part is arranged to face the surroundings. In this part, a battery drawer with a battery 100 may be placed. Also, an extractor 90 may be comprised in the front plate. Other components may be placed in the housing 80 or associated with the front plate part, such as further microphones or connectors for wired contact with other equipment like telephones.

Figure 2:
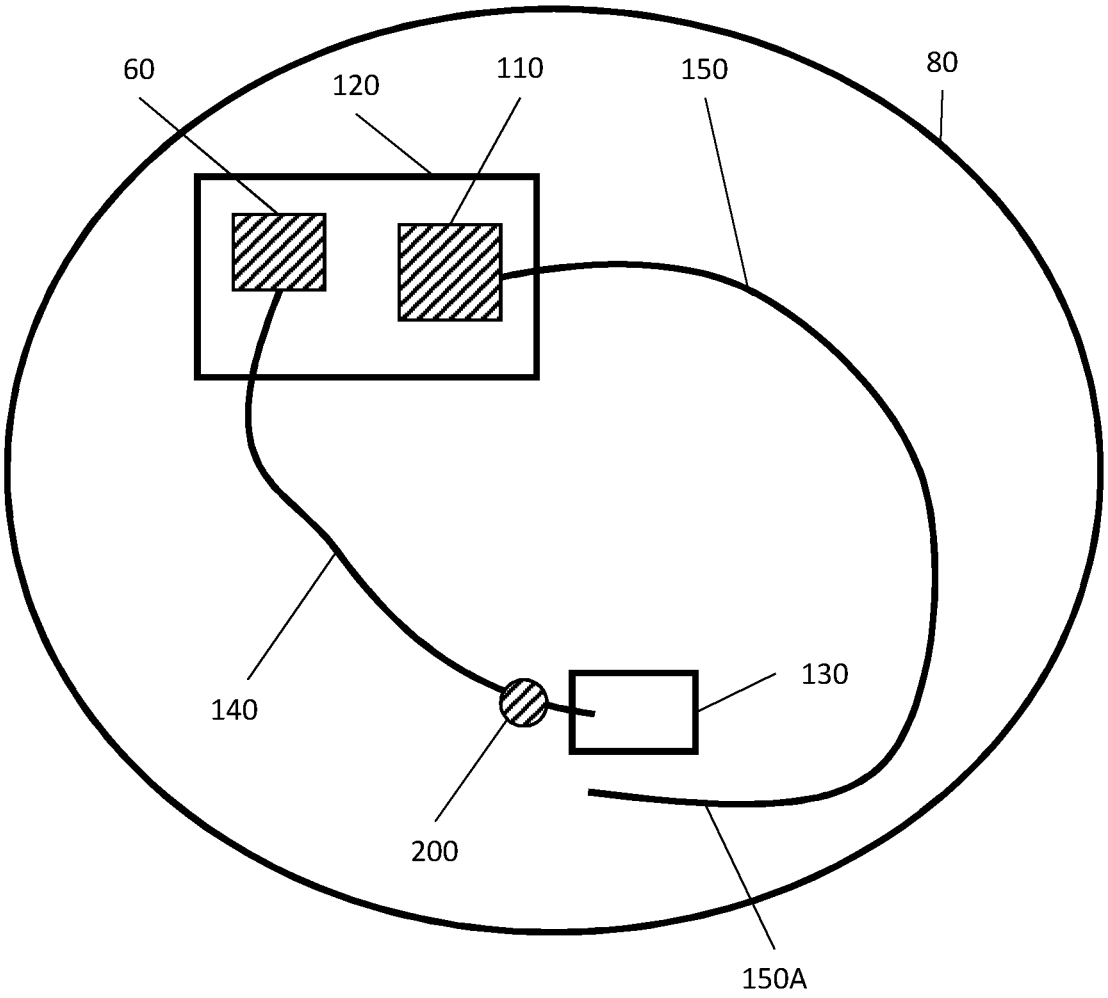
FIG. 2 is a schematic view of a hearing aid.

FIG. 2 shows a schematic view of a hearing aid. The hearing aid will comprise a transmission and/or reception circuit (wireless interface) 110 in order to feed/receive electromagnetic energy to/from the antenna 150. This wireless interface 110 is connected to the antenna 150 and to the signal processing unit 60 using a connection, which is not shown in the drawing. The feed line from the wireless interface to the antenna may comprise a coaxial line so as to ensure that the antenna signal is disturbed as little as possible, and/or to insure that the antenna has a well defined starting point. The outer conductor of the coaxial line may be terminated to a ground component, which could e.g. be the relatively large battery. The signal processing unit 60 and the wireless interface may be placed on a substrate 120, which is arranged in the housing 80 and which may comprise a printed circuit board, a ceramic plate, or the like. The wireless interface 110 may be configured to be an independent circuit part or can be configured as part of the signal processing unit 60.

Even further, the substrate 120 may comprise the wireless interface 110 on one side of the substrate 120, and the processor 60 at another side. Since the antenna is connected to the wireless interface, this configuration reduces a coupling between the antenna and electronic elements, which are placed on the other side of the substrate, where the processor is placed.

It is noted that the substrate 120, on which the signal processing unit 60 is arranged, can be placed at many different positions and in different orientations. This allows for a greater flexibility, which facilitates to design custom made adaptations of the hearing aid.

The signal processing unit 60 is further connected to an external electrical element 130 such as the microphone 50 or the transducer 70 using an electrical connection 140. Other examples of electronic elements 130, which may be placed inside the housing 80 yet may be placed apart from the substrate 120, include a volume wheel, a magnetic switch, a mechanical switch, a button, a battery, a printed circuit board, a grounding element, or a combination thereof. For example, a volume wheel and a mechanical switch may be arranged on a separate printed circuit board and be connected to the signal processing unit 60 by an electrical connection line 140.

The antenna 150, which is configured to emit and/or receive electromagnetic fields, is placed inside the housing 80 in order to achieve optimal sending/receiving performance. Furthermore, it is connected to the wireless interface 110, which can thus send out or receive electromagnetic signals through the antenna.

The wireless interface supplying power and/or receiving power from the antenna may be placed at one side of the battery, and at the opposite side a tip of the antenna may be positioned. The battery is most often cylindrical with two opposite, flat sides connected by a surface, e.g. such as a 312 battery, a 13 battery or the like, however, other types of batteries exists.

By placing e.g. a wireless interface at one side of a large, conductive object and an end of an antenna so that the large, conductive object shadows for possible electromagnetic emissions to/from the circuitry at the wireless interface. This could help reduce electromagnetically induced noise in the system.

In the following, the case of an electric monopole antenna is discussed, while however, any of the above mentioned types of antennas may be used.

The antenna 150 is tuned to radiate and/or receive electromagnetic energy in the frequency range of 50 MHz to 10 GHz, while preferably the antenna is tuned to radiate and/or receive electromagnetic energy at 2.4 GHz and/or 5 GHz.

The antenna 150 may be any antenna capable of operating at these frequencies, and the antenna may thus be a resonant antenna, such as monopole antenna, a dipole antenna, etc. The resonant antenna may have a length of lambda/4 or any multiple thereof, lambda being the wavelength corresponding to the emitted electromagnetic field.

Depending of the type of antenna 150 used, a ground plane or ground body may be required for the operation of the antenna. In this case, a ground plane or a ground body is provided within the housing 80. A battery can be used as a ground plane, which allows to omit a further ground plane element, and hence can save space.

Since the housing 80 of the hearing aid needs to be small, the antenna may be arranged e.g. in a circular shape. Therefore, it may be that the end portion 150A of the antenna 150 comes close to the electronic element 130.

In case of an antenna 150 having a more complex shape, e.g. a ring-shape, loop shape or the like, the end portion 150A may refer to a part of the antenna 150, which in terms of length of the electrical path of the antenna 150 is close to a middle part of the antenna. Alternatively, the end portion 150A may refer to that part of the antenna 150, where a coupling to an electronic element 130 is strongest.

A decoupling element 200 may be provided in the electrical connection line 140, wherein the decoupling element 200 can be described to have a characteristic frequency fres when connected to the electrical connection line 140. Preferably, the characteristic frequency fres is matched to the frequency at which the antenna is tuned to radiate and/or receive the electromagnetic fields. The decoupling element 200 may be provided close to the electronic element 130.

The decoupling element 200 may be, or perform like, an inductor such as a coil, a chip inductor, a ferrite-core inductor coil, a choke, a decoupling coil or a decoupling coil having a ferrite core, a band-stop filter or a notch filter. The decoupling element 200 is an inductor, which blocks or dampens high-frequency alternating currents in the electrical connection line 140, while low-frequency signals, or out-of-band signals, i.e. higher and lower frequencies, generally pass without being dampened. The characteristic frequency fres is a resonance frequency, and sometimes referred to as the coil resonant frequency. The decoupling element 200 may have a low Q factor for limiting a broader band of frequencies, but can also be a high Q-factor inductor, which can be precisely tuned for a small frequency range e.g. matched to the frequency at which the antenna is tuned to send or receive electromagnetic energy.

Furthermore, the decoupling element 200 may comprise a ferrite-core or a ferrite bead around one or more wires, which form the electrical connection line 140. A ferrite core or ferrite bead inductor will not only result in an increased impedance of the electrical connection line 140 to which it is applied, but also will provide a resistance in the ferrite, which effectively can cause additional loss to high frequency signals transmitted through this line. This allows the decoupling element 200 to be more efficient.

A band-stop filter may e.g. be comprised of one or more RLC elements, which individually are comprised of a resistor having a resistivity R, an inductor having an inductivity L and a capacitor having a capacity C. Furthermore, the band-stop filter may be a first-order filter, a second order filter, or a higher-order filter.

Even further, the decoupling element 200 may be comprised of different individual decoupling elements 200. Furthermore, several decoupling elements 200 may be provided. This allows for an improved decoupling, which therefore reduces the noise, improves the signal/noise ratio, which in turn leads to longer battery lifetime.

The hearing aid further may comprise a parasitic antenna element arranged in the housing.

Parasitic antenna elements may be comprised of simple conductors, metallic plates or shapes, or a metallic thin film on an internal or external surface of the hearing aid housing 80 or an internal part of the hearing aid. This configuration allows to improve the antenna performance as well as to improve a directivity of the antenna. As a consequence, a mutual coupling between the antenna and the electronic element can be reduced, so that the above mentioned effects can be achieved.

Figure 3:
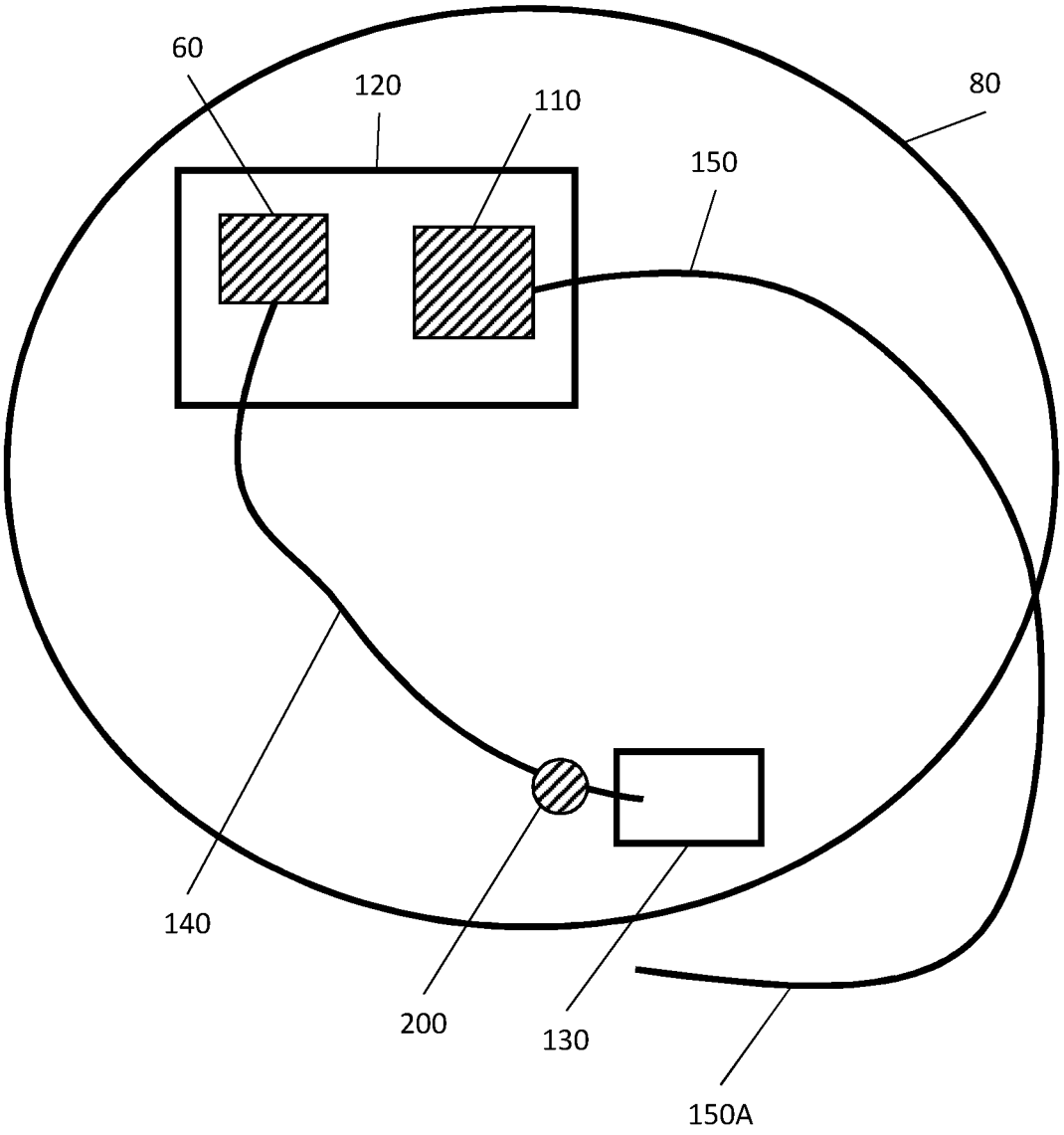
FIG. 3 is a schematic view of a hearing aid.

FIG. 3 shows a schematic view of a hearing aid. It is noted that as appropriate, only differences to the hearing aid above are described.

In FIG. 3 it is shown that a part of the antenna 150 is guided to the outside of the housing 80. Since the end portion 150A of the antenna 150A is close to the electronic element 130, mutual coupling between the antenna 150 and the electronic element 130 can be strong. In order to reduce this coupling, a decoupling element 200 is provided in the electrical connection line 140. The antenna 150, which is guided to the outside of the housing 80 can also be used as extractor 90 as shown in FIG. 1.

Such an arrangement allows that the antenna 150 is guided into a direction towards an outside of the wearer's head 30, which allows for a higher sending/receiving efficiency of the antenna 150. This may be because due to a high water content in the head 30 of the wearer, electromagnetic waves having a frequency in the above-mentioned frequency range, which travels through the wearer's head 30, will be strongly dampened making through-head communication difficult.

For communicating between two hearing aids arranged at respective left and rights ears of the user/wearer, a second communication system may be included. Such a second communication system may be based on inductive communication, and often named a near-field magnetic induction system. Such a system may communicate through the head of the user with low loss, making it more energy efficient than high-frequency systems for ear-to-ear communication. The second communication system may utilize a coil arranged e.g. in the faceplate, where the coil may be placed so that the coil axis is aligned with a coil axis of a coil positioned in a hearing aid positioned at the user other ear.

Figure 4:
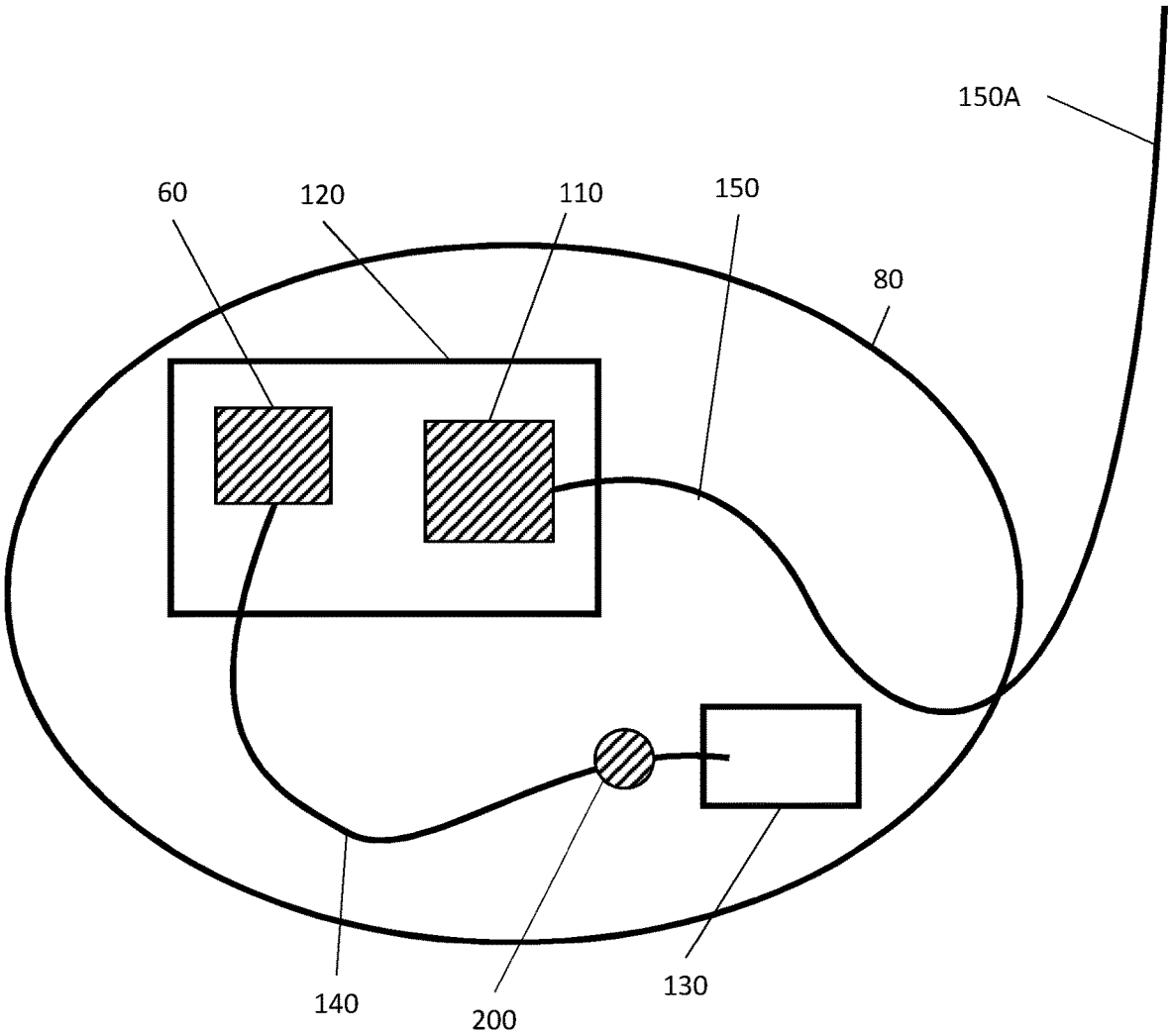
FIG. 4 is a schematic view of a hearing aid.

FIG. 4 shows another modification of a hearing aid. Only differences are described in the following and the description of same or equivalent components will be omitted.

In FIG. 4, the end portion 150A of the antenna 150 is not positioned close to the electronic element 130. However, the electronic element 130 may be close to another part of the antenna 150. However, the coupling between the antenna 150 and the electronic element 130 can still be strong. In order to reduce this coupling, a decoupling element 200 is provided in the electrical connection line 140. The antenna 150, which is guided to the outside of the housing 80 can also be used as extractor 90 as shown in FIG. 1.

Such an arrangement allows guiding the antenna 150 into a direction towards an outside of the wearer's head 30, which allows for a higher sending/receiving efficiency of the antenna 150 as described before.

Figure 5:
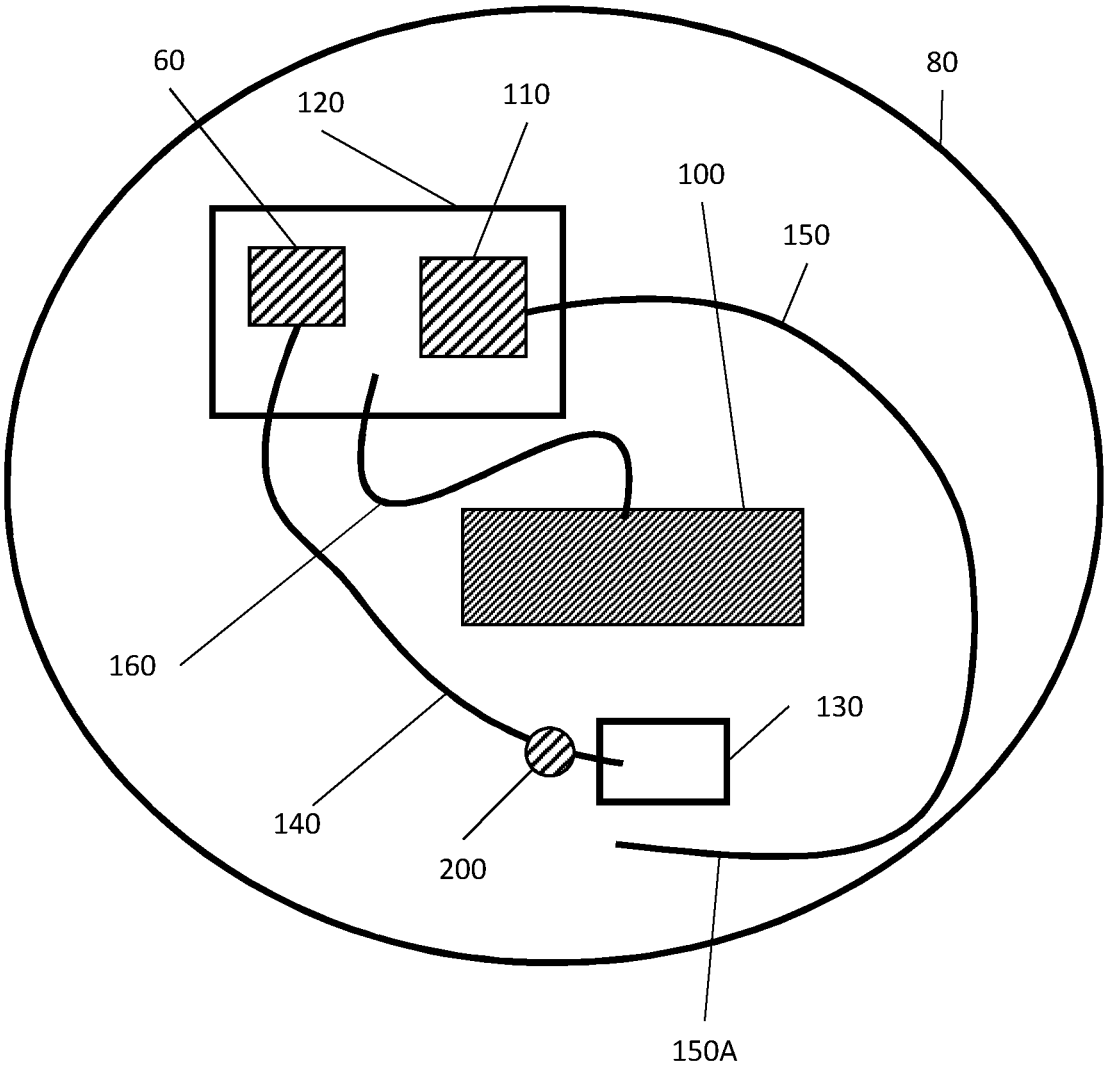
FIG. 5 is a schematic view of a hearing aid.

FIG. 5 shows an arrangement. Only differences are described in the following and the description of same or similar previous components will be omitted.

In FIG. 5, a battery 100 is shown, which is connected the substrate 120 using a battery connection line 160. The battery 100 provides electric energy for the operation of the hearing aid, the operation of the wireless interface 110, the signal processing unit 60 and the like. The battery 100 can be any type of battery, such as a replaceable, a rechargeable or a single use battery. If the battery is a rechargeable battery, a charging mechanism is provided, which is not shown in the drawings. Furthermore, the battery may have any geometrical shape, such as a button shape, a disk shape, a flat shape or a circular shape.

The antenna 150 can be provided to be wound several times around the battery 100 or can be provided in a coil-like only on one side of the battery 100. Also in this case, at least a part of the antenna 150 is arranged at least partly around the battery 100, so that the emission characteristics of the antenna 150 can be further improved.

The configuration shown in FIG. 5, allows using the battery 100 as a ground plane for the operation of the antenna 150. It is noted that only for some types of antennas the provision of a ground plane is recommendable. However, especially for monopole antennas and similar antenna types, a ground plane is beneficial. It is further noted that for other antenna types, such as a dipole antenna, a ground plane also modifies the emission characteristics of the antenna 150 so that the arrangement of the antenna 150 around the battery 100 can be used to improve e.g. the directivity of the antenna 150 or the efficiency and the gain of the antenna 150.

Furthermore, if the battery 100 is used as a ground plane, a further ground plane element can be omitted, which therefore saves space within the hearing aid.

As described above, the electronic element 130 can be close to a part of the antenna, such as e.g. the end portion 150A of the antenna. Hence, the coupling between the antenna 150 and the electronic element 130 can be strong. In order to reduce this coupling, a decoupling element 200 is provided in the electrical connection line 140, which provides for the effects described above.

Figure 6:
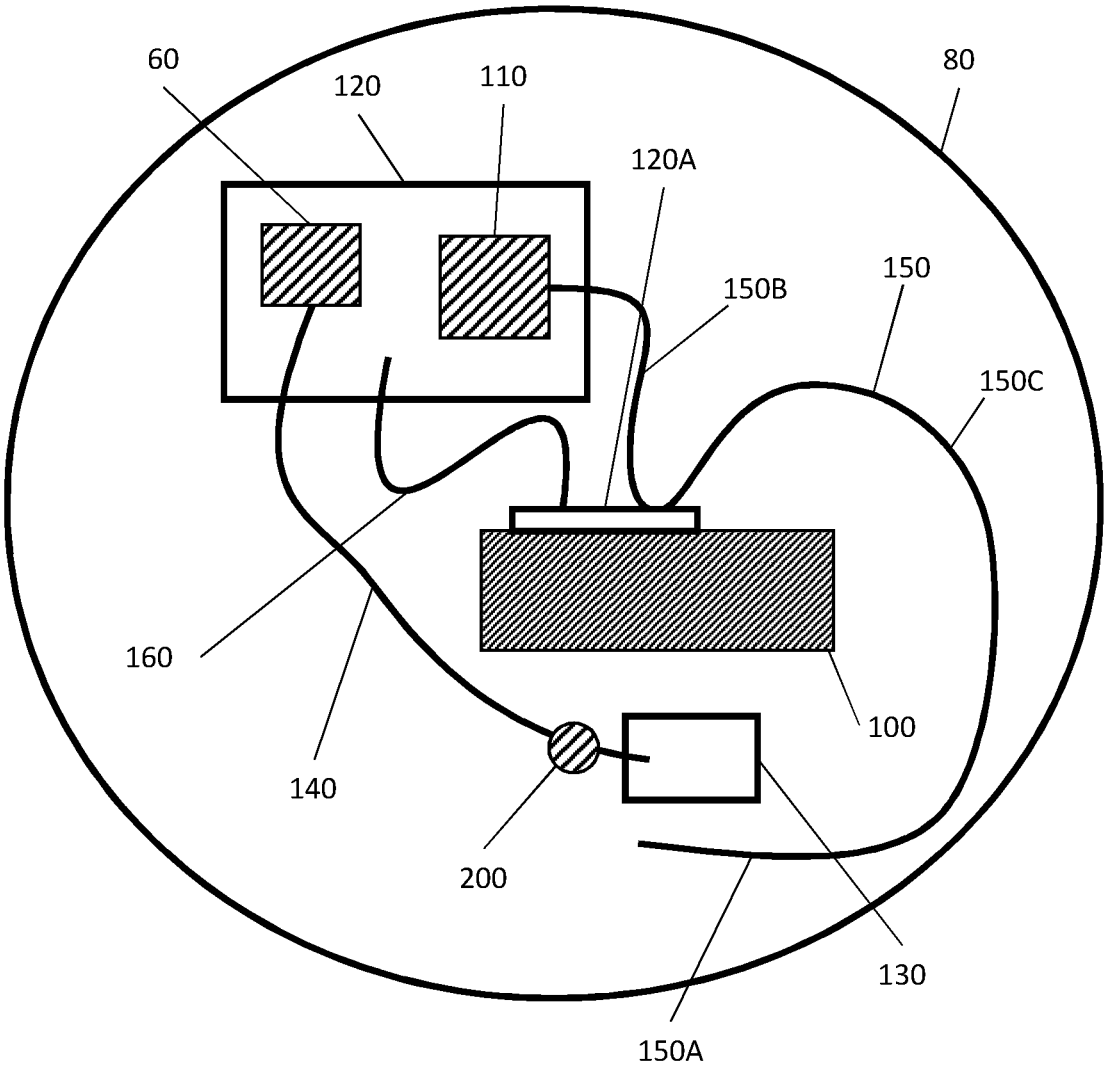
FIG. 6 is a schematic view of a hearing aid.

FIG. 6 shows an arrangement. Only differences are described in the following and the description of same or similar components previously described will be omitted.

In FIG. 6, a second substrate 120A is provided in close vicinity of the battery 100. The second substrate 120A may provide contacts to the battery 100 as well as may provide e.g. the charging mechanism or a function to evaluate the charging state of the battery 100. The charging state may be derived from a battery voltage, or a charging or discharging characteristic of the battery.

Furthermore, the antenna 150 may be positioned in such a way that the antenna 150 comprises a first portion 150B, which is arranged between the substrate 120 and the second substrate 120A, while a second portion 150C is arranged to comprise the end portion 150A of the antenna 150. The first portion 150B may be comprised of a different wiring type than the second portion 150C, and the transition point between the different wire types can be placed on the second substrate. For example, the first portion may be comprised of a shielded wire, such as a coaxial wire, while the second portion may be comprised of a single wire, a flexible wire, a wiring strip on a flexible substrate or the like.

Since the first portion 150B, which is comprised of a shielded wire, cannot efficiently send/receive electromagnetic energy, this arrangement allows using the second portion 150C of the antenna 150 as the radiating portion of the antenna 150 similar to the above mentioned antenna. This allows for a greater flexibility in arranging the antenna 150 within the housing 80. Even more, this arrangement allows placing the substrate 120 nearly independently of the arrangement of the antenna 150.

As described above, the electronic element 130 can be close to a part of the antenna 150, such as e.g. the end portion 150A of the antenna. Hence, the coupling between the antenna 150 and the electronic element 130 can be strong. In order to reduce this coupling, a decoupling element 200 is provided in the electrical connection line 140, which provides for the effects described above.

Figure 7A:
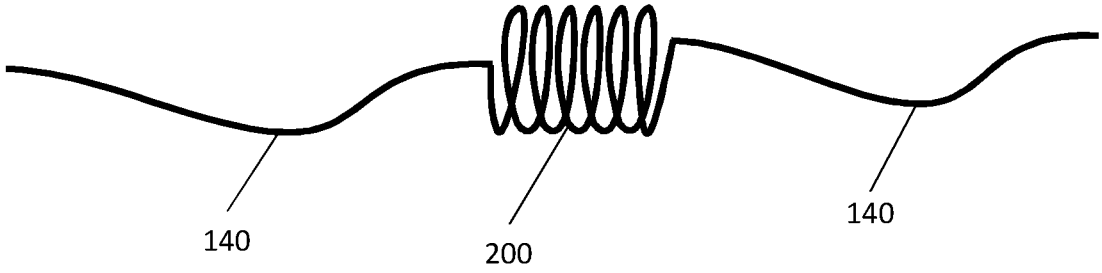
FIG. 7A is a schematic view of a decoupling element.
Figure 7B:
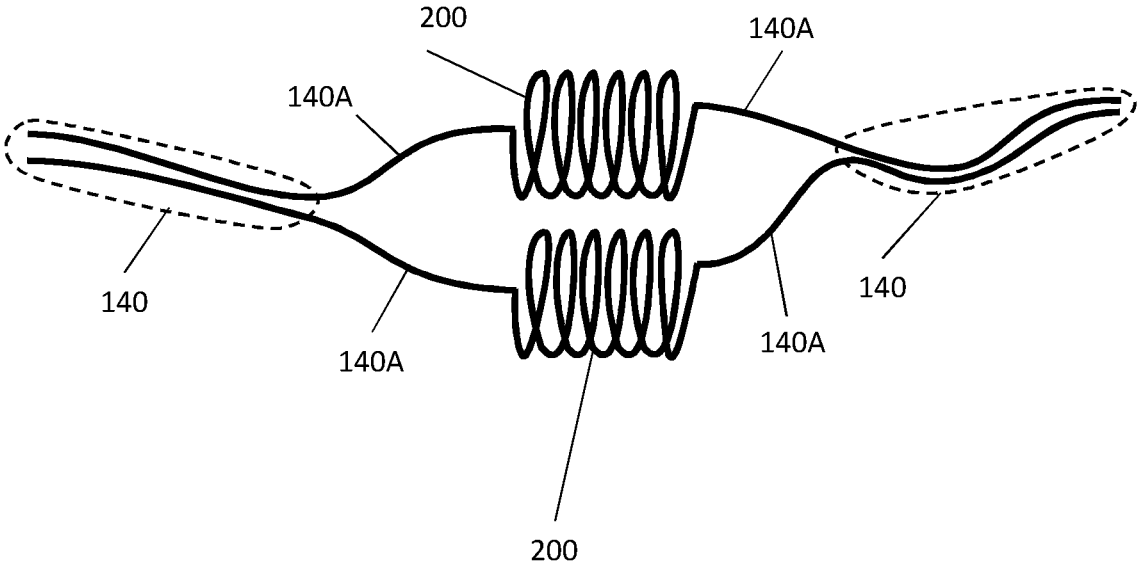
FIG. 7B is a schematic view of a decoupling element.

FIGS. 7A and 7B are schematic views of a decoupling element 200.

As shown in FIG. 7A, a decoupling element 200 may be provided in the electrical connection line 140. Preferably, the characteristic frequency fres of the decoupling element 200 in conjunction with the electrical connection line 140 is matched to the frequency at which the antenna 150 is tuned to radiate and/or receive the electromagnetic fields.

The decoupling element 200 may be an inductor such as a coil, a ferrite-core inductor coil, a choke, a decoupling coil or a decoupling coil having a ferrite core, a band-stop filter or a notch filter. The decoupling element may be provided on the wire (such as a ferrite bead), in the wire (such as a coil, or a coil having a ferrite core), or may be provided in the electrical connection line 140 on a separate substrate such as a printed circuit board or the like.

While the provision of a ferrite bead or the like allows for simple manufacturing, the provision of a coil having a ferrite core or the like additionally allows for an improved decoupling. Providing the decoupling element 200 on a separate substrate additionally allows for easier mounting of the decoupling element within the hearing aid, and a more reproducible arrangement, so that the quality of the hearing aid can be improved.

Furthermore, several decoupling elements 200 may be provided along the electrical connection line 140. This allows for an improved decoupling, which therefore reduces the noise, improves the signal/noise ratio, which in turn leads to longer battery lifetime.

Even further, the decoupling element 200 can be comprised of different individual decoupling elements as shown in FIG. 7B. In case that an electrical conduction line 140 is comprised of different individual electrical conduction lines 140A, the electrical conduction line 140 can be split up, and a decoupling element 200 can be provided for any individual electrical conduction line 140A. Even though FIG. 7B only shows that the electrical conduction line 140 is comprised of two individual electrical conduction lines 140A, the electrical conduction line 140 can be comprised also of three or more individual electrical conduction lines 140A. Furthermore, a decoupling element may also be provided only to some of the individual electrical conduction lines 140A.

A decoupling element may be arranged on one side of a component, e.g. an input transducer, such as a microphone, and then connected to a line connecting the component with other circuitry. This allow induced electromagnetic signals to be filtered out near the component.

In one version of a hearing aid having a hearing aid housing, the hearing aid may comprise two input transducers arranged at different sides of a battery, and where a decoupling element is arranged at each of the input transducers. An antenna may be arranged in the hearing aid, e.g. arranged at least partly around the battery. A circuit board may also be arranged in the hearing aid housing. The circuit board may hold: one or more processors, one or more memory units, one or more wireless interfaces. The hearing aid may comprise an inductive coil arranged to receive and/or transmit inductive communication signals.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening elements may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure.

The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

LIST OF REFERENCE SIGNS

10 ear drum
20 ear canal
30 head
40 outer ear (pinna)
50 microphone/signal receiver
60 signal processing unit
70 transducer/loudspeaker
80 housing
90 external antenna/pull out string
100 battery
110 wireless interface
120 substrate
120A second substrate
130 electronic element
140 electrical connection line
140*a* individual electrical connection line
150 antenna
150A end portion of the antenna
160 battery connection line
200 decoupling element

The invention claimed is:

1. A hearing aid having a housing, comprising:

a substrate carrying a wireless interface, the substrate further carrying a processor, the substrate arranged in the housing;

an antenna arranged in the housing, the antenna being connected to the wireless interface; the antenna configured to emit and/or receive electromagnetic fields, an electronic element, connected to the processor via an electrical connection line, wherein a decoupling element is provided in the electrical connection line wherein the decoupling element has a characteristic frequency at the frequency, at which the antenna is tuned to radiate and/or receive the electromagnetic fields, so that the decoupling element provides at least a dampening of a signal around at least one of the operational frequencies of the antenna, wherein the antenna comprises an external part arranged outside the housing, wherein the hearing aid further comprises a battery, and wherein at least a part of the antenna is arranged at least partly around the battery.

2. The hearing aid according to claim 1, wherein the electronic element is positioned at an end portion of the antenna.

3. The hearing aid according to claim 2, wherein the antenna is arranged at least partly in a loop.

4. The hearing aid according to claim 2, wherein the decoupling means is, or functions as, an inductor.

5. The hearing aid according to claim 1, wherein the antenna is arranged at least partly in a loop.

6. The hearing aid according to claim 5, wherein the decoupling means is, or functions as, an inductor.

7. The hearing aid according to claim 1, wherein the decoupling means is, or functions as, an inductor.

8. The hearing aid according to claim 1, wherein the antenna is tuned to radiate and/or receive electromagnetic energy in the frequency range of 50 MHz to 10 GHz.

9. The hearing aid according to claim 8, wherein the antenna is further tuned to radiate and/or receive electromagnetic energy at 2.4 GHz and/or 5 GHz.

10. The hearing aid according to claim 1, wherein the electronic element comprises multiple electrical connection lines, and a decoupling element is included in each of the multitude of electrical connection lines.

11. The hearing aid according to claim 1, wherein the hearing aid is to be placed behind the outer ear of a user, at least partially in the inner canal of the ear of a user, or in the bony region of the ear of the user.

12. The hearing aid according to claim 1, wherein the electrical connection line comprises a single wire, a twisted pair of single wires, a conductive path on a ridged substrate or flexible substrate, a flexible conductor on flexible a substrate, a coaxial cable, or combinations thereof.

13. The hearing aid according to claim 1, wherein the electronic element is a microphone, a volume wheel, a magnetic switch, a mechanical switch, a button, a battery, a printed circuit board, a transducer, a grounding element, or a combination thereof.

14. The hearing aid according to claim 1, wherein the antenna comprises or is arranged as a monopole antenna, a dipole antenna, a slot antenna, a two-arm monopole antenna, a three-arm monopole antenna, a multiple-arm monopole antenna, a multiple-arm antenna, a folded monopole antenna, a patch antenna, a loop antenna, a fractal antenna, a flex antenna, a ceramic chip antenna, an injection-molded thermoplastic part with integrated electronic circuit traces, a printed antenna or any combinations thereof.

15. The hearing aid according to claim 1, wherein the hearing aid further comprises a parasitic antenna element arranged in the housing.

16. The hearing aid according to claim 1, wherein the substrate comprises the wireless interface on one side of the substrate, and the processor at another side.

17. The hearing aid according to claim 1, wherein the electronic element is arranged at a tip or distal portion of the antenna and the decoupling element is arranged at the electronic component.

18. The hearing aid according to claim 17, further comprising a second electronic component arranged at a side of a battery opposite the electronic element, so that the two electronic components are arranged at opposite sides of the battery.

19. The hearing aid according to claim 1, wherein the decoupling means is, or functions as, a coil, a ferrite-core inductor coil, a choke, a decoupling coil, a ferrite bead, a ferrite ring, or a decoupling coil having a ferrite core, a band-stop filter, or a notch filter.

* * * * *